United States Patent [19]

Anderson et al.

[11] Patent Number: 4,875,257

[45] Date of Patent: Oct. 24, 1989

[54] TACK BUTTON AND METHOD OF MAKING THE SAME

[75] Inventors: Robert E. Anderson, Roselle; Michael L. Baritz, Highland Park, both of Ill.

[73] Assignee: Handy Button Machine Company, Melrose Park, Ill.

[21] Appl. No.: 204,169

[22] Filed: Jun. 8, 1988

[51] Int. Cl.[4] ..... A44B 1/18

[52] U.S. Cl. ..... 24/90 B; 24/90 R; 24/90 A

[58] Field of Search ..... 24/90 R, 90 A, 90 B, 24/90 C, 113 R, 113 MP, 103; 5/472

[56] References Cited

U.S. PATENT DOCUMENTS

| | | | |
|---|---|---|---|
| 464,149 | 12/1891 | Cook | 24/90 R |
| 553,938 | 2/1896 | Reichelt | 24/90 R |
| 1,375,873 | 4/1921 | Waldes | 24/90 R |
| 1,851,618 | 3/1932 | Cowdrey | 24/90 A |
| 2,144,926 | 1/1939 | Lawton | 24/90 A |
| 2,835,948 | 5/1958 | Blake | 24/90 R |
| 3,242,544 | 3/1966 | Dritz | 24/113 R |
| 3,829,935 | 8/1974 | Critchfield | 24/90 B |
| 4,580,320 | 4/1986 | Takata | 24/90 A |
| 4,654,934 | 4/1987 | Hasegawa | 24/113 R |

*Primary Examiner*—Victor N. Sakran
*Attorney, Agent, or Firm*—Caliste J. Alster

[57] ABSTRACT

A back support structure for mounting a tack and for a securement to a front button shell of a decorative tack button, has a structure including a plastic support member integrally molded to include an annular body having an open central recess, a bottom wall formed below the recess, and a through-aperture opening into said recess. Said body also has an interior wall extending inwardly from said bottom wall and an apertured tack retainer member is inserted into said recess and supported on said bottom wall. Said interior wall has a portion of the plastic of the support member deformed radially inwardly against said retainer member to clamp said retainer member against said bottom wall.

10 Claims, 2 Drawing Sheets

FIG. 2
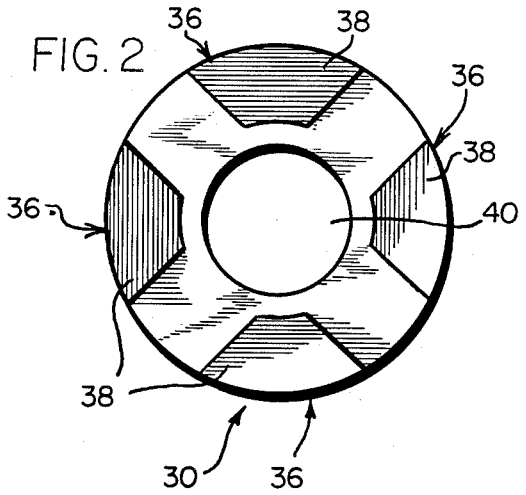
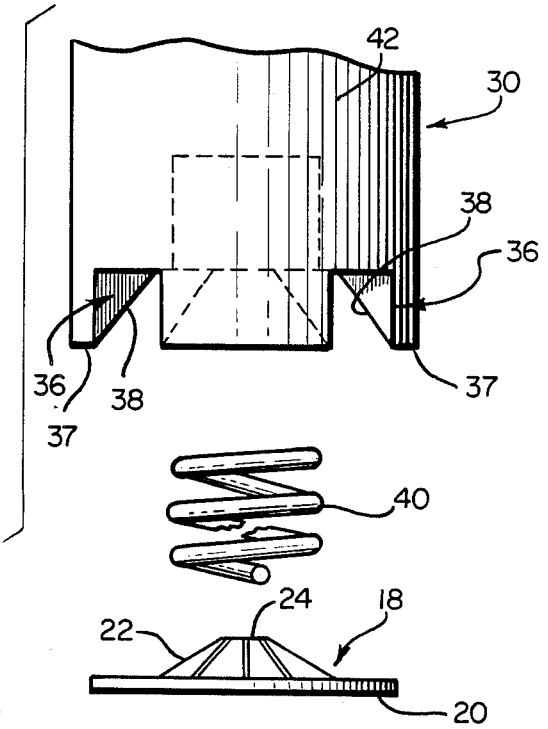
FIG. 1
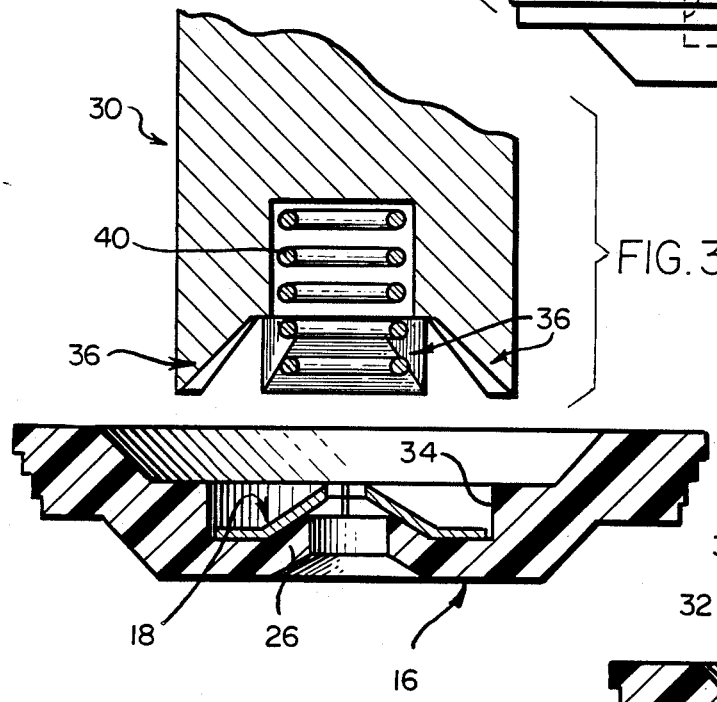
FIG. 3
FIG. 4
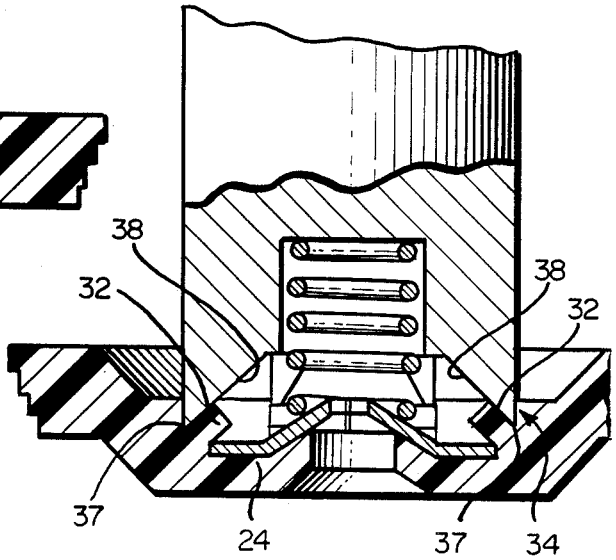

TACK BUTTON AND METHOD OF MAKING THE SAME

BACKGROUND OF THE INVENTION

This invention relates to decorative buttons, and more particularly to the support structure for buttons which can be secured by a tack for mounting, for example on clothing or upholstered furniture.

In a conventional "tack button" which is mounted on clothing or upholstery using a tack, the supporting back of the button is a metal collet with an inserted, metal, tack retaining flange having an aperture which is locked to the grooved shank of the mounting tack. The tack retaining insert is secured within the metal collet by striking tabs from the metallic wall of the collet and bending them against the flange portion of the insert to lock the insert against the collet. The tabs must be punched from the wall of the collet using small punch tools so that the tabs and the perforations left by the displaced metal of the tab are kept as small as possible to maintain the integrity of the remaining collet wall and support of the button. The sidewise motion of the punching tools cause a contact and misaligning displacement of the insert itself. In addition, the small punching tools frequently break so that partly formed or missing tabs allow the insert to loosen during or after the tack is driven into the button, and the failure of defective buttons is compounded by the effort and difficulty in the operation to remove them. These disadvantages are eliminated by the structure for tack buttons in accordance with this invention, which does not require sidewise motion or punching of a metallic collet backing of the button.

SUMMARY OF THE INVENTION

In accordance with the present invention, a tack button is provided with a back support member which is molded plastic so that the tack retainer insert is locked within the plastic support member by swaging portions of the plastic material without requiring perforation of the adjacent portions of the plastic support. The relatively softer plastic material can be swaged rather than punched in a single vertical motion of a swaging tool which is accurate and durable. The plastic support member is molded to include an apertured seat for the swaged tack retaining insert.

In a preferred embodiment, the seat on the plastic support member has a conical portion which generally conforms to and supports the typical conical portion of the tack retaining insert so that the seat reinforces opposition to motion tending to back out the tack or loosen the securement of the button to clothing or upholstery, for example. The tack-retaining back support structure can be assembled in a telescoped manner with a button shell carrying the decorative fabric so the peripheral margins of the fabric are wrapped around a flange of the shell and the resulting inturned marginal portions are clinched between a serrated peripheral wall of the plastic back member and the annular shell flange.

BRIEF DESCRIPTION OF THE DRAWING

FIG. 1 is an exploded view of the tooling and assembly of a tack-retaining back support structure for a decorative tack button in one embodiment of the invention;

FIG. 2 is, a plan view of the working end of the tooling shown in FIG. 1;

FIG. 3 is an intermediate step in the assembly of the support structure shown in FIG. 1;

FIG. 4 is a final step in the assembly operation for the support structure in FIGS. 1 and 3;

DETAILED DESCRIPTION OF THE ILLUSTRATED EMBODIMENT

Figure 6:
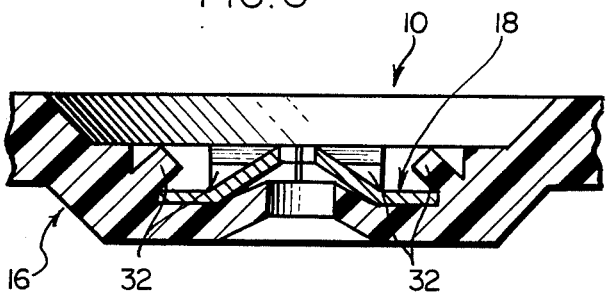
FIG. 6 is a sectional view taken along Line 6—6 n FIG. 5, viewed in the indicated direction.
Figure 8:
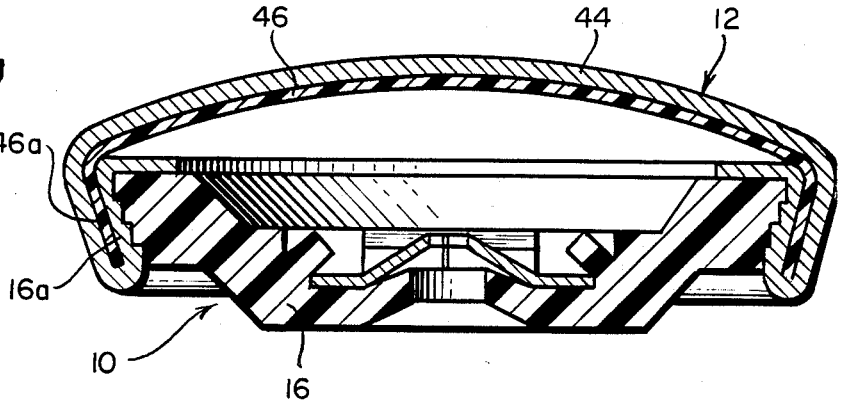
FIG. 8 is a sectional view showing a tack button assembled from the support structure shown in FIGS. 5 and 6; and, FIG. 9 a sectional view of the tack button of FIG. 8 and illustrating the button secured by an inserted tack to a portion of furniture upholstery.
Figure 9:
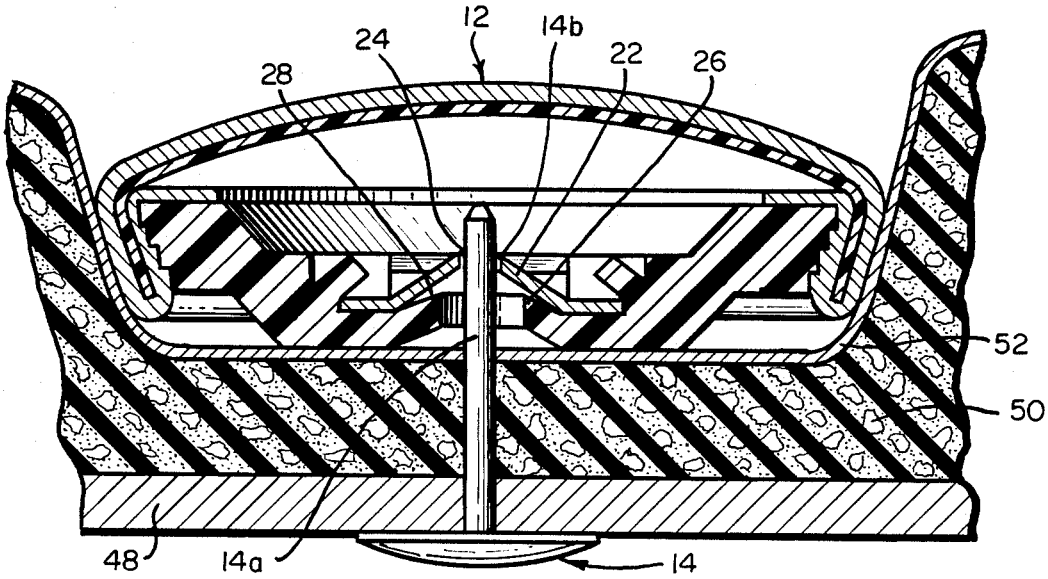

Referring now in more detail to the drawing, which illustrates a preferred form of the invention, FIGS. 1–4 illustrate the fabrication and assembly of a tack retainer structure generally designated by reference character 10. The completed retainer structure 10 is best shown in FIG. 6, and is subsequently assembled to form the support back of a decorative button 12 as shown in FIG. 8. As shown in FIG. 9, the button 12 can be secured to, for example, clothing or furniture by a tack 14 which is driven through the back of the button 12 and retained by the retaining structure 10 as more fully described hereinafter.

Figure 5:
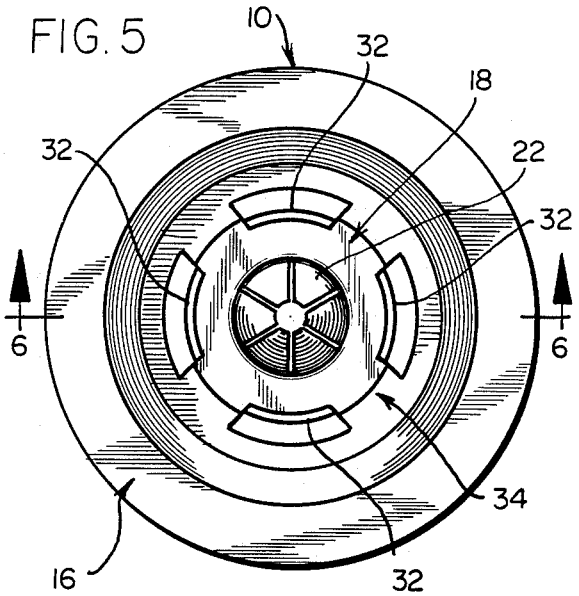
FIG. 5 is a plan view of the completed support structure assembled as shown in FIG. 1–4.

Referring again to FIG. 1, the retainer structure 10 includes a plastic, unitary back member 16 which is molded, for example, from nylon, high density polyethylene, or a similar resin which can cold, machine swaged without fracturing. The retainer structure 10 also includes a conventional tack retainer insert 18 which is centrally apertured and radially serrated as shown in FIG. 5.

Figure 7:
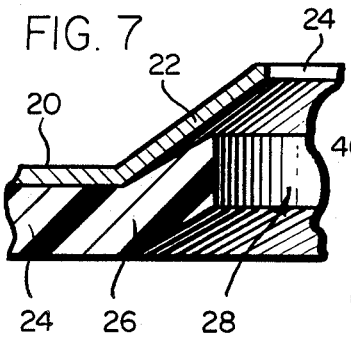
FIG. 7 is an enlarged, fragmentary view of the apertured portions of the support structure shown in FIG. 6.

The insert 18 has a peripheral, annular flange 20 circumscribing a projecting, central cone 22 which tapers to an aperture 24. The flange 20 and cone 22 are seated on (or slightly spaced as shown in FIG. 7) respective, mating flat and conical portions 24 and 26 of the recessed supporting floor formed in the molded back 16. The conical portion 26 is through apertured 28 in alignment with the aperture 24 of the insert 18.

Referring again to FIG. 1 and 3, assembly of the retainer structure 10 is begun by laying the insert 18 in seated position on the conical floor portion 24. In order to secure the insert, a reciprocating swaging tool 30 is vertically lowered to impinge and radially inwardly deform swage portions 32 of annular wall 34 upstanding from the flat floor portion 24 of the molded back 16 as shown in FIG. 4. The swage portions 32 clamp the flange 20 and insert 18 against the supporting floor of the back 16 to secure the assembly of the retainer structure 10.

Referring again to FIG. 1 and 2, the fabricating end of the swaging tool 30 has a series of four downwardly-tapered, arcuate knife projections 36 which are equally spaced in an annular pattern at the peripheral wall of the tool 30 as shown in FIG. 2. The sharp, leading edges 37 of the metallic knives 36 impact and make clean, arcuate cuts in the softer plastic wall 34 of the back 16. Thereafter, continued lowering of the swaging tool 30 causes the inwardly inclined knife walls 38 to displace and bend radially inwardly the swage portions 32 of the cut walls 34. The results of this swaging operation produces the four swage portions 32 which lock the insert 18 to the floor of the back 16. During the swaging operation, a helical spring 40 centrally projection from the tool 30 engages the conical portion 22 of the insert 18 to ensure the central alignment of the insert 18 in relation to the surrounding knives 36 which follow this initial engagement by the projecting end of the spring 40. The other end of the spring 40 is secured at the closed end of a central, blind bore 42 in the tool 30.

In contrast to the previous lateral motion of small tooling projections in order to strike retaining tabs from previous metallic backing supports for the tack retainer insert, the swaging tool of the invention requires only a single vertically downward stroke motion to displace the locking swage portions of the molded plastic back in the simplified fabricating method for assembly of a retainer structure.

Referring now to FIG. 8, the button 12 is assembled from the retainer structure 10; the decorative fabric covering 44 is overlaid on the outside of a domed shell 46 of thin metal so that the margins of the covering 44 are inturned around the ridges of the frusto-conical peripheral skirt or shell wall 46*a*. The inturned covering margins are then clinched between the shell wall 46*a* and the serrated peripheral surface of the annular collar 16*a* of the plastic back 16- all in a known manner so that the serration prevents the covering from slipping loose.

Referring now to FIG. 9, a particular example of use of the button in upholstery is shown in which the tack shank 14*a* is driven through a furniture back board 48 and through the foam 50 and upholstery fabric 52; the shank 14*a* passes through the aligned back aperture 28 and insert aperture 24 so that the inner margin of the conical wall 22 annularly abuts one of the circular ridges 14*b* on the tack shank. As a result, the foam 50 and fabric 52 are compressed to the desired degree under the clamping provided by the tack button 12. The locking of the ridge 14*b* against the conical wall 22 is reinforced by the conical floor portion 26 of the plastic back 16 which supports the conical wall 22 and opposes inward motion of the conical wall 22 to prevent backing out of the tack shank 14*a* and loosening of the button from the upholstery.

In light of the foreqoing description of the embodied button and retainer structure, modifications will be evident to those skilled in such fabrication. For example, the swaging of the plastic back over the retainer insert can be a continuous annulus, however, best results have been obtained by the illustrated segmenting of the swage portions which better supports the swaged plastic material.

The invention is claimed as follows:

1. A tack retaining back support structure for securement to a front button shell of a decorative tack button, comprising:

(1) a plastic support member integrally molded and including an annular body having an open central recess and a bottom wall formed below the recess and having a through-aperture opening into said recess, said body further having an interior wall extending inwardly from said bottom wall toward said recess; and (2) a tack retainer member inserted into said recess and supported on said button wall, and having a retainer aperture, aligned with said through aperture for receiving a tack shank therethrough and for peripherally gripping and retaining said shank, said interior wall having at least a portion of the plastic thereof deformed radially inwardly against said retainer member to clamp said retainer member against said bottom wall.

2. The support structure according to claim 1 wherein said bottom wall of said support member includes a conical portion tapering inwardly to said through aperture, and wherein said retainer member includes a conical portion tapering toward said retainer aperture and generally conforming to said bottom wall conical portion for seating thereon.

3. The support structure according to claim 1 in combination with a button shell and fabric covering upon said shell, wherein said shell and fabric are secured to a peripheral wall of said support member body insaid combination forming a decorative button.

4. The combination according to claim 3 wherein an inturned portion of said covering fabric is clinched between a flange portion of said shell and said peripheral wall of said support member.

5. A tack retaining back support structure for securement to a front button shell of a decorative tack button, comprising:

(1) a plastic support member integrally molded and including an annular body having an open central recess and a bottom wall formed below the recess and having a through aperture opening into said recess, said bottom wall including a conical portion tapering inwardly to said through aperture, said body further having an interior wall extending inwardly from said bottom wall toward said recess; and (2) a tack retainer member inserted into said recess and supported on said bottom wall, and having a retainer aperture aligned with said through aperture for receiving a tack shank therethrough and for peripherally gripping and retaining said shank, said retainer member including a conical portion tapering toward said retainer aperture and generally conforming to said bottom wall conical portion for seating thereon, said interior wall having at least a portion thereof swaged radially inwardly against said retainer member to clamp said retainer member against said bottom wall.

6. The support structure according to claim 5 in combination with a button shell and fabric covering upon said shell, wherein said shell and fabric are secured to a peripheral wall of said support member body in said combination forming a decorative button.

7. The combination according to claim 6 wherein an inturned portion of said covering fabric is clinched between a flange portion of said shell and said peripheral wall of said support member.

8. A method of making a tack button support structure which comprises providing a button back constituting a unitary plastic element having a central opening therethrough and a conical seat portion surrounding said central opening, assembling with said element a tack retainer insert such that said insert rests upon said conical seat portion, and swaging in a single motion a plurality of tabs formed on said element adjacent to said seat and disposed about said insert to clinch said insert between the tabs and adjacent portions of said element.

9. The method according to claim 8 further comprising mounting a button shell and fabric covering thereon upon said support structure so that said fabric is secured to a peripheral wall of said plastic element to form a decorative button.

10. The method according to claim 8 further comprising telescoping with said support structure a button shell having a cover thereon so that the periphery of the plastic element cooperates with the button shell to clinch the cover there between resulting in a tack button in which the unitary plastic element forms the back of the button.

* * * * *